US009284628B2

(12) United States Patent
Aoyama et al.

(10) Patent No.: US 9,284,628 B2
(45) **Date of Patent: *Mar. 15, 2016**

(54) COPPER ALLOY SHEET AND METHOD FOR PRODUCING SAME

(75) Inventors: Tomotsugu Aoyama, Shizuoka (JP); Akira Sugawara, Shizuoka (JP)

(73) Assignee: DOWA METALTECH CO., LTD., Tokyo (JP)

( * ) Notice: Subject to any disclaimer, the term of this patent is extended or adjusted under 35 U.S.C. 154(b) by 379 days.

This patent is subject to a terminal disclaimer.

(21) Appl. No.: 12/671,259

(22) PCT Filed: May 21, 2009

(86) PCT No.: PCT/JP2009/059732

§ 371 (c)(1),
(2), (4) Date: Jan. 29, 2010

(87) PCT Pub. No.: WO2010/134210

PCT Pub. Date: Nov. 25, 2010

(65) Prior Publication Data

US 2012/0049130 A1 Mar. 1, 2012

(30) Foreign Application Priority Data

May 19, 2009 (JP) ..... 2009-121221

(51) Int. Cl.

| | |
|---|---|
| ***C22F 1/08*** | (2006.01) |
| ***H01B 1/02*** | (2006.01) |
| ***C22C 9/02*** | (2006.01) |
| ***C22C 9/06*** | (2006.01) |

(52) U.S. Cl.

CPC ... *C22C 9/02* (2013.01); *C22C 9/06* (2013.01); *C22F 1/08* (2013.01)

(58) Field of Classification Search

USPC ..... 148/433; 420/473
IPC ..... C22C 9/02,9/06; C22F 1/08
See application file for complete search history.

(56) References Cited

U.S. PATENT DOCUMENTS

| | | | | |
|---|---|---|---|---|
| 2006/0045790 | A1* | 3/2006 | Hatakeyama | 420/473 |
| 2008/0190524 | A1* | 8/2008 | Gao et al. | 148/682 |

FOREIGN PATENT DOCUMENTS

| | | |
|---|---|---|
| JP | 4-154942 | 5/1992 |
| JP | 4-236736 | 8/1992 |
| JP | 10-226835 | 8/1998 |
| JP | 2000-73130 | 3/2000 |
| JP | 2000-80428 | 3/2000 |
| JP | 2000-129377 | 5/2000 |
| JP | 2000-256814 | 9/2000 |
| JP | 2001-262255 | 9/2001 |
| JP | 2001-262297 | 9/2001 |
| JP | 2002-294368 | 10/2002 |
| JP | 2008-231492 | 10/2008 |
| JP | 2009-62592 | 3/2009 |

* cited by examiner

*Primary Examiner* — Sikyin Ip
(74) *Attorney, Agent, or Firm* — Bachman & LaPointe, P.C.

(57) ABSTRACT

A copper alloy sheet has a chemical composition containing 0.1 to 5 wt % of nickel, 0.1 to 5 wt % of tin, 0.01 to 0.5 wt % of phosphorus and the balance being copper and unavoidable impurities, and has a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}})$ 4.0, assuming that the degree of orientation of a {hkl} crystal plane measured by the powder X-ray diffraction method on the rolled surface of the copper alloy sheet is $f_{\{hkl\}}$.

11 Claims, No Drawings

COPPER ALLOY SHEET AND METHOD FOR PRODUCING SAME

TECHNICAL FIELD

The present invention generally relates to a copper alloy sheet and a method for producing the same. More specifically, the invention relates to a Cu—Ni—Sn—P alloy sheet, which is used for electric and electronic parts, such as connectors, and a method for producing the same.

BACKGROUND ART

The materials used for electric and electronic parts as the materials of current-carrying parts, such as connectors, lead frames, relays and switches, are required to have a good electric conductivity in order to suppress the generation of Joule heat due to the carrying of current, as well as such a high strength that the materials can withstand stress applied thereto during the assembly and operation of electric and electronic apparatuses using the parts. The materials used for electric and electronic parts, such as connectors, are also required to have an excellent bending workability since the parts are generally formed by bending after press blanking. Moreover, in order to ensure the contact reliability between electric and electronic parts, such as connectors, the materials used for the parts are required to have an excellent stress relaxation resistance, i.e., a resistance to such a phenomenon (stress relaxation) that the contact pressure between the parts is deteriorated with age.

In recent years, there is a tendency for electric and electronic parts, such as connectors, to be integrated, miniaturized and lightened. In accordance therewith, the sheets of copper and copper alloys serving as the materials of the parts are required to be thinned, so that the required strength level of the materials is more severe. In particular, since connectors for automobiles and so forth are used in environments wherein violent vibrations are repeatedly applied thereto, the materials thereof are required to have a high fatigue strength, i.e., a property which is difficult to cause fatigue failure.

In accordance with the miniaturization and complicated shape of electric and electronic parts, such as connectors, it is required to improve the precision of shape and dimension of products manufactured by bending the sheets of copper alloys. For that reason, there is recently often applied a so-called bending after notching wherein a sheet is bent along a notch which is formed by carrying out notching (working for forming the notch) in a portion of the sheet. However, in the bending after notching, portions near the notch portion are work-hardened by notching, so that cracks are easily produced in the subsequent bending operation. Therefore, the bending after notching is a very severe bending process for materials. However, the materials of electric and electronic parts, such as connectors, are generally bent so that the bending axis thereof is a direction (TD) perpendicular to a rolling direction (LD) and thickness direction.

Moreover, as the increase of cases where electric and electronic parts, such as connectors, are used in severe environments, the requirements for the stress relaxation resistance of the parts are more severe. For example, the stress relaxation resistance of electric and electronic parts, such as connectors, is particularly important when the parts are used for automobiles in high-temperature environments. Furthermore, the stress relaxation resistance is such a kind of creep phenomenon that the contact pressure on the spring portion of the material of electric and electronic parts, such as connectors, is deteriorated with age in a relatively high-temperature (e.g., 100 to 200° C.) environment even if it is maintained to be a constant contact pressure at ordinary temperature. That is, the stress relaxation resistance is such a phenomenon that the stress applied to a metal material is relaxed by plastic deformation produced by the movement of dislocation, which is caused by the self-diffusion of atoms forming a matrix and the diffusion of the solid solution of atoms, in a state that the stress is applied to the metal material.

However, there are generally trade-off relationships between the strength and electric conductivity of the sheet of a copper alloy, between the strength and bending workability thereof, and between the bending workability and stress relaxation resistance thereof, respectively. Therefore, in conventional methods, a sheet having a good electric conductivity, strength, bending workability or stress relaxation resistance is suitably chosen in accordance with the use thereof as a material used for a current-carrying part, such as a connector.

Among the sheets of copper alloys, the sheets of Cu—Ni—Sn—P alloys have a good balance between the electric conductivity, strength, bending workability and stress relaxation resistance, and are easily produced. The sheets of Cu—Ni—Sn—P alloys have the functions of carrying out the solid-solution strengthening (or hardening) thereof by Sn and Ni. In addition, in the sheets of Cu—Ni—Sn—P alloys, the above-described characteristics are improved by finely dispersing Ni—P precipitates. Thus, there are proposed various sheets of Cu—Ni—Sn—P alloys as the materials used for electric and electronic parts, such as connectors (see, e.g., Japanese Patent Laid-Open Nos. 4-154942, 4-236736, 10-226835, 2000-129377, 2000-256814, 2001-262255, 2001-262297 and 2002-294368).

There are also proposed a Cu—Ni—Sn—P alloy sheet wherein a texture having the {420} plane as a principal orientation component is developed to be optimized for the bending after notching (see, e.g., Japanese Patent Laid-Open No. 2008-231492), a Cu—Ni—Sn—P alloy sheet wherein the development of Brass orientation is suppressed to improve the stress relaxation resistance and bending workability thereof (see, e.g., Japanese Patent Laid-Open No. 2009-62592), and sheets of Cu—Ni—Si alloys (so-called Corson alloys) being high-strength copper alloys wherein a texture having the {100} plane as a principal orientation component is developed to improve the bending workability and press blankability thereof (see, e.g., Japanese Patent Laid-Open Nos. 2000-80428 and 2000-73130). These copper alloy sheets are designed so as to avoid the anisotropy of characteristics on the rolled surface thereof to maintain the strength and bending workability thereof.

The sheets of Cu—Ni—Sn—P alloys have a relatively high strength (a tensile strength of 500 to 600 MPa) and a relatively high electric conductivity (30 to 50% IACS) to have an excellent balance between the strength and electric conductivity thereof. The stress relaxation resistance of the sheets of Cu—Ni—Sn—P alloy is far better than that of the sheets of general solid-solution strengthening type copper alloys, such as brass and phosphor bronze, and is equal to or higher than that of the sheets of Cu—Ni—Si alloys (so-called Corson alloys) and the sheets of precipitation strengthening type copper alloys, such as Cu—Ti alloys. Moreover, the sheets of Cu—Ni—Sn—P alloys have an excellent bending workability, and are suitable for the materials of connectors for automobiles.

Generally, Cu—Ni—Sn—P alloys have a good castability since they are basically solid-solution strengthening type alloys and since the amounts of easily oxidized elements, such as Si, Ti, Mg and Zr, can be decreased even if the elements are added to carry out the precipitation strengthening and to fine the cast structure thereof. Moreover, the sheets of Cu—Ni—Sn—P alloys can be produced at relatively low costs since it is possible to omit complicated heat treatment steps, such as solution and ageing treatments, which are required to produce the sheets of precipitation strengthening type copper alloys.

However, in recent years, electric and electronic parts, such as connectors, are severely required to be thinned and miniaturized. In order to meet such severe requirements, it is required to further enhance the strength level of the sheets of Cu—Ni—Sn—P alloys. For example, when the sheets are required to be high strength sheets having a tensile strength of not less than 600 MPa, and further, not less than 650 MPa, it is very difficult for conventional Cu—Ni—Sn—P alloys to have a higher strength without increasing the producing costs while maintaining the excellent stress relaxation resistance and bending workability.

As general methods for enhancing the strength of Cu—Ni—Sn—P alloys, there are known a method for adding a large amount of solute elements, such as Ni and Sn, and a method for increasing a finish rolling (temper rolling) reduction. However, in the method for adding a large amount of solute elements, the electric conductivity of the sheets of the alloys is remarkably deteriorated, and the amount of relatively expensive Ni, Sn or the like to be added is increased to be uneconomical. In the method for increasing the finish rolling reduction, the bending workability of the sheets of the alloys is deteriorated as the extent of work hardening is enhanced. For that reason, even if the strength level and the electric conductivity are high, there are some cases where the sheets can not be used for electric and electronic parts, such as female terminals, which are required to be manufactured by box-bending. On the other hand, there is a method for adding a large amount of elements, such as Ni and P, which contribute to the amount of precipitates. However, there are some cases where the addition of the large amount of these elements to form coarse precipitates which serve as the origins of the production of cracks to deteriorate the bending workability and fatigue strength of the sheets. In addition, if it is controlled so as to form fine precipitates even if a large amount of these elements are added, the number of heat treatments is increased, and/or the producing conditions are limited, so that the producing costs are increased.

In order to improve the bending workability of a sheet of a copper alloy, a method for fining the crystal grains of the copper alloy is generally adopted. As the crystal grain size of the copper alloy is smaller, the area of grain boundaries existing per a unit volume thereof is larger. The grain boundaries function as interfaces which allow boundary sliding and rotation of crystal grains on both sides thereof during bending. Therefore, as the area of grain boundaries is larger, there is a tendency for local stress concentration to be avoided to improve the bending workability of the sheet. However, the increase of the area of grain boundaries due to grain refining causes to promote the stress relaxation which is a kind of creep phenomenon. Particularly, in connectors for automobiles and so forth which are used in high-temperature environments, the diffusion rate along the grain boundaries of atoms is far higher than that in the grains, so that the deterioration of the stress relaxation resistance due to grain refining causes a serious problem. Moreover, there are some cases where grain boundaries serve as the origins of fatigue fracture since they act as storage portions for dislocation during repeated bending operations to cause work hardening. In such temperature environments, grain refining is not always suitable for the improvement of fatigue strength. In addition, there are some cases where connectors for automobiles are influenced by vibrations of engines in accordance with the connecting portions and connecting methods thereof, so that fatigue failure is caused in and around electric cable crimping portions. Such fatigue failure is caused if work hardening and partial stress concentration portions are caused by methods for forming serrations and crimping electric cables while collapsing them in order to strongly crimp the electric cables and in order to improve the tight fitting of the electric cables into connectors. In addition, since the spring portions of female terminals are narrow and severely work-hardened by the 180° bending, the contact pressure applied thereto is deteriorated by stress relaxation due to fatigue and heat caused by vibrations, so that a critical problem is capable of being caused. In order to solve these problems, there has been taken measures, such as the improvement of the structures of connectors and the structures supported by housings, and the prevention of vibrations of electric cables. However, from the standpoint of costs and the degree of freedom of design, it is greatly expected to improve the characteristics of the materials of connectors. Therefore, it is considered that a method for causing the materials of connectors to have appropriate texture is effective in order to prevent excessive work hardening in serrations and crimping portions, since it reasonably suppresses work hardening.

In recent years, as a method for solving the problems on both of the strength and bending workability of the sheets, there are proposed a method for developing a predetermined texture of the sheets, and a method for suppressing the development of a predetermined texture of the sheets. For example, Japanese Patent Laid-Open No. 2008-231492 discloses a method for developing a texture having the {420} plane as a principal orientation component, and Japanese Patent Laid-Open No. 2009-62592 discloses a method for suppressing the development of Brass orientation. However, in the method for developing a texture having the {420} plane as a principal orientation component, there is a problem in that the producing loads at rolling steps are increased since the number of heat treatments is extremely limited until a sheet is obtained as a final product. In the method for suppressing the development of Brass orientation, it is not possible to increase the rolling reduction in final rolling, so that it is difficult to sufficiently improve the strength of the sheet by utilizing work hardening.

Thus, it is difficult to improve both of the bending workability and stress relaxation resistance of the sheets of Cu—Ni—Sn—P alloys while improving the strength and fatigue strength thereof. Particularly, in recent years, in order to use electric and electronic parts, such as connectors for automobiles, in severe environments, it is desired to produce a copper alloy sheet which has an excellent strength, electric conductivity, bending workability and stress relaxation resistance and which is difficult to cause fatigue failure.

DISCLOSURE OF THE INVENTION

It is therefore an object of the present invention to eliminate the aforementioned problems and to provide a copper alloy sheet which has high levels of strength, electric conductivity, fatigue strength, bending workability and stress relaxation resistance, and a method for producing the same.

In order to accomplish the aforementioned and other objects, the inventors have diligently studied and found that it is possible to produce a copper alloy sheet which has high levels of strength, electric conductivity, fatigue strength, bending workability and stress relaxation resistance, if the copper alloy sheet has a chemical composition comprising 0.1 to 5 wt % of nickel, 0.1 to 5 wt % of tin, 0.01 to 0.5 wt % of phosphorus and the balance being copper and unavoidable impurities, and has a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 4.0$, assuming that the degree of orientation of a {hkl} crystal plane measured by the powder X-ray diffraction method on the rolled surface of the copper alloy sheet is $f_{\{hkl\}}$. Thus, the inventors have made the present invention.

That is, a copper alloy sheet according to the present invention has a chemical composition comprising 0.1 to 5 wt % of nickel, 0.1 to 5 wt % of tin, 0.01 to 0.5 wt % of phosphorus and the balance being copper and unavoidable impurities, the copper alloy sheet having a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 4.0$, assuming that the degree of orientation of a {hkl} crystal plane measured by the powder X-ray diffraction method on the rolled surface of the copper alloy sheet is $f_{\{hkl\}}$.

The chemical composition of the copper alloy sheet may further comprise one or more elements which are selected from the group consisting of 3 wt % or less of iron, 5 wt % or less of zinc, 1 wt % or less of magnesium, 1 wt % or less of silicon and 2 wt % or less of cobalt. The chemical composition of the copper alloy sheet may further comprise one or more elements which are selected from the group consisting of chromium, boron, zirconium, titanium, manganese and vanadium, the total amount of these elements being 3 wt % or less.

A method for producing a copper alloy sheet according to the present invention, comprises: a melting and casting step of melting and casting the raw materials of a copper alloy having a chemical composition which comprises 0.1 to 5 wt % of nickel, 0.1 to 5 wt % of tin, 0.01 to 0.5 wt % of phosphorus and the balance being copper and unavoidable impurities; a hot rolling step of carrying out a hot rolling operation as an initial hot rolling pass in a temperature range of from 950° C. to 700° C. after the melting and casting step, and then, carrying out a hot rolling operation in a temperature range of from less than 700° C. to 350° C.; a cold rolling step of carrying out a cold rolling operation at a rolling reduction of not less than 60% after the hot rolling step; a recrystallization annealing step of carrying out a heat treatment for recrystallization at a reaching temperature of 400 to 750° C. for a holding time after the cold rolling step; and a finish cold rolling step of carrying out a cold rolling operation at a rolling reduction of 40 to 95% after the recrystallization annealing step, wherein the hot rolling operations at the hot rolling step are carried out so as to satisfy $3 \leq (\rho_{ST}-\rho_H)/\chi_P \leq 16$, assuming that the specific resistance of the copper alloy sheet after the hot rolling step is $\rho_H$ (μΩ·cm), that the specific resistance of the copper alloy sheet quenched after being held at 900° C. for 30 minutes after the hot rolling step is $\rho_{ST}$ (μΩ·cm), and that the concentration of P contained in the copper alloy sheet during the casting is $\chi_P$ (wt %), and wherein the holding time and the reaching temperature are set for carrying out the heat treatment in a temperature range of from 400° C. to 750° C. at the recrystallization annealing step so that the copper alloy sheet has a crystal orientation satisfying $2.5 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 2.8$, assuming that the degree of orientation of a {hkl} crystal plane measured by the powder X-ray diffraction method on the rolled surface of the copper alloy sheet after the recrystallization annealing step is $f_{\{hkl\}}$.

In this method for producing a copper alloy sheet, the chemical composition of the copper alloy sheet may further comprise one or more elements which are selected from the group consisting of 3 wt % or less of iron, 5 wt % or less of zinc, 1 wt % or less of magnesium, 1 wt % or less of silicon and 2 wt % or less of cobalt. The chemical composition of the copper alloy sheet may further comprise one or more elements which are selected from the group consisting of chromium, boron, zirconium, titanium, manganese and vanadium, the total amount of these elements being 3 wt % or less.

In the above-described method for producing a copper alloy sheet, the cold-rolling reduction before the recrystallization annealing step is preferably in the range of from 60% to 95%. In addition, a low-temperature annealing is preferably carried out at a temperature of 150 to 450° C. after the finish cold-rolling step. Moreover, a cold rolling operation and a heat treatment may be repeated in that order between the hot rolling step and the cold rolling step.

According to the present invention, it is possible to provide a copper alloy sheet which has high levels of strength, electric conductivity, fatigue strength, bending workability and stress relaxation resistance, and a method for producing the same.

BEST MODE FOR CARRYING OUT THE INVENTION

The preferred embodiment of a copper alloy sheet according to the present invention has a chemical composition consisting of: 0.1 to 5 wt % of nickel (Ni); 0.1 to 5 wt % of tin (Sn); 0.01 to 0.5 wt % of phosphorus (P); optionally one or more elements which are selected from the group consisting of 3 wt % or less of iron (Fe), 5 wt % or less of zinc (Zn), 1 wt % or less of magnesium (Mg), 1 wt % or less of silicon (Si) and 2 wt % or less of cobalt (Co); optionally one or more elements which are selected from the group consisting of chromium (Cr), boron (B), zirconium (Zr), titanium (Ti), manganese (Mn) and vanadium (V), the total amount of these elements being 3 wt % or less; and the balance being copper and unavoidable impurities. The copper alloy sheet has a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 4.0$, assuming that the degree of orientation of a {hkl} crystal plane measured by the powder X-ray diffraction method on the rolled surface of the copper alloy sheet is $f_{\{hkl\}}$. The preferred embodiment of a copper alloy sheet and a method for producing the same according to the present invention will be described below in detail.

[Composition of Alloy]

The preferred embodiment of a copper alloy sheet according to the present invention is a sheet of a Cu—Ni—Sn—P alloy containing Cu, Ni, Sn and P, preferably a Cu—Ni—Sn—P alloy consisting of four elements of Cu, Ni, Sn and P. The Cu—Ni—Sn—P alloy may optionally contain other elements, such as Zn and Fe.

Nickel (Ni) serves to form a solid solution in a Cu matrix to contribute to the improvement of the strength, elasticity and heat resistance of the copper alloy sheet. In particular, Ni serves to form a compound with P to contribute to the improvement of the electric conductivity and stress relaxation resistance of the copper alloy sheet. If the content of Ni is less than 0.1 wt %, it is difficult to sufficiently provide these effects. Therefore, the content of Ni is required to be 0.1 wt % or more. The content of Ni is preferably 0.3 wt % or more, more preferably 0.5 wt % or more, and most preferably 0.7 wt % or more. On the other hand, if the content of Ni is excessive, the electric conductivity of the copper alloy sheet is easily deteriorated. Therefore, the content of Ni is required to be 5 wt % or less. The content of Ni is preferably 3 wt % or less, more preferably 2 w % or less, more preferably 1.5 wt % or less, and most preferably less than 1.2 wt %.

Tin (Sn) has the function of carrying out the solid-solution strengthening or hardening of the copper alloy sheet. In particular, this function is greater if Sn, together with Ni, is added to the copper alloy. In addition, Sn has the function of improving the stress relaxation resistance of the copper alloy sheet. In order to sufficiently provide these functions, the content of Sn is required to be 0.1 wt % or more. The content of Sn is preferably 0.3 wt % or more, and more preferably 0.5 wt % or more. On the other hand, if the content of Sn exceeds 5 wt %, the electric conductivity of the copper alloy sheet is remarkably lowered. In addition, Sn is an element which is easily segregated, so that cracks are easily produced during hot rolling. Therefore, the content of Sn is required to be 5 wt % or less. The content of Sn is preferably 3 wt % or less, and more preferably 2 wt % or less.

Phosphorus (P) has the function of improving all of the strength, electric conductivity and stress relaxation resistance of the copper alloy sheet by generating precipitates with Ni. In addition, P has the function of decreasing the concentration of oxygen in a molten metal by acting as a deoxidizer when the raw materials of the copper alloy are melted and cast. In order to sufficiently provide these functions, the content of P is required to be 0.01 wt % or more. The content of P is preferably 0.03 wt % or more, and more preferably 0.04 wt % or more. On the other hand, if the content of P exceeds 0.5 wt %, coarse precipitates of Ni—P are generated, and/or the concentration of hydrogen is increased by excessive deoxidation, so that the copper alloy sheet easily has casting defects and cracks during hot rolling. In addition, the electric conductivity and bending workability of the copper alloy sheet are deteriorated. Therefore, the content of P is required to be 0.5 wt % or less. The content of P is preferably 0.2 wt % or less, and more preferably 0.15 wt % or less.

Iron (Fe) serves to generate precipitates with P, and there are some cases where Fe generates ternary compounds with Ni in addition to P. If a very small amount of Fe is added to the copper alloy, nucleation sites for Fe—P compounds or Ni—Fe—P compounds are dispersed, so that fine precipitates are easily generated. However, if the content of Fe is excessive, the precipitates are aggregated or coarsened. Therefore, if the copper alloy sheet contains Fe, the content of Fe is required to be 3 wt % or less. The content of Fe is preferably 1 wt % or less, and more preferably 0.5 wt % or less.

Zinc (Zn) has the function of improving the castability of the copper alloy, in addition to the function of improving the solderability and strength of the copper alloy sheet. If Zn may be added to the copper alloy, there is an advantage in that inexpensive brass scraps may be used. However, if the content of Zn exceeds 5 wt %, the electric conductivity and stress corrosion cracking resistance of the copper alloy sheet are easily deteriorated. Therefore, if the copper alloy sheet contains Zn, the content of Zn is preferably 5 wt % or less, and more preferably 2 wt % or less.

Manganese (Mn) serves to form a solid solution in copper, and part thereof serves to form compounds with P. In addition, Mn has the function of improving the stress relaxation resistance of the copper alloy sheet, and the function of desulfurizing the copper alloy sheet. However, since Mg is an element which is easily oxidized, the castability of the copper alloy is remarkably deteriorated if the content of Mg exceeds 1 wt %. Therefore, if the copper alloy sheet contains Mg, the content of Mg is preferably 1 wt % or less, and more preferably 0.5 wt % or less.

Cobalt (Co) is an element capable of forming precipitates with P and of precipitating alone, and has the function of improving both of the strength and electric conductivity of the copper alloy sheet. However, since Co is an expensive element, it is uneconomical that the content of Co exceeds 2 wt %. Therefore, if the copper alloy sheet contains Co, the content of Co is preferably 2 wt % or less, and more preferably 1.5 wt % or less.

As other elements optionally added to the copper alloy sheet, there are Cr, B, Zr, Ti, Mn, V and so forth. For example, Cr, B, Zr, Ti, Mn and V have the function of further improving the strength of the copper alloy sheet and of decreasing the stress relaxation thereof. In addition, Cr, Zr, Ti, Mn and V are easy to generate high melting-point compounds with unavoidable impurities, such as S and Pb, which exist in the copper alloy sheet. Moreover, B, Zr and Ti have the function of fining the cast structure of the copper alloy sheet, and can contribute to the improvement of the hot workability of the copper alloy sheet. If the copper alloy sheet contains one or more elements which are selected from the group consisting of Cr, B, Zr, Ti, Mn and V, the total amount of these elements is preferably 0.001 wt % or more in order to sufficiently provide the functions of the elements to be added. However, if the total amount of these elements exceeds 3 wt %, it has a bad influence on the hot workability and cold workability of the copper alloy sheet, and it is uneconomical. Therefore, the total amount of these elements is required to be 3 wt % or less. The total amount of these element is preferably 2 wt % or less, more preferably 1 wt % or less, and most preferably 0.5 wt % or less.

[Texture]

The bending workability of all of sheets is generally deteriorated as the strength thereof is improved. Therefore, it is ideal that a manufacturing process is designed so as to balance the improvements of the strength and bending workability of the sheets. However, in "a spring-integrated box female terminal" which is one of connectors, spring portions required to have the highest strength are formed so as to extend in the coil width directions (TD) of a copper alloy sheet used for the terminal, whereas portions required to be subjected to severe broad bending, such as the bending after notching, are formed so as to extend in the rolling direction (LD) of the copper alloy sheet. That is, it is desired to find a crystal orientation (texture) capable of providing the best spring property in the TD while providing the excellent bending workability in the LD by improving the relative strength in the TD to the strength in the LD. This expression of anisotropy does not remarkably deteriorate the bending workability in the TD, which conventionally causes harmful effects, and is required to have the bending workability capable of sufficiently adapting the copper alloy sheet to the narrow bending in the TD, which is required to form a spring, although the bending workability in the TD is inferior to that in the LD.

In the preferred embodiment of a copper alloy sheet according to the present invention, there is utilized an index of anisotropy (Ia) allowing an in-plane anisotropy, which is based on the texture of the rolled sheet of the copper alloy, to be handled by one non-dimensional quantity. This index indicates the uniform relationship to the relative tensile strength of the sheet in the TD to the tensile strength thereof in the LD, and shows that the strength of the sheet in the TD can be improved without deteriorating the bending workability of the sheet in the LD as the index is higher. That is, if the index of the sheet is increased, the tensile strength and yield strength of the sheet in the TD are selectively improved, and the sheet can be optimally utilized for spring-integrated box female terminals. In the preferred embodiment of a method for producing a copper alloy sheet according to the present invention which will be described later, the rate of crystal grains having such a characteristic texture is controlled by the chemical composition of the copper alloy and the manufacturing conditions thereof. By such a characteristic texture, it is possible to improve both of the strength and bending workability of the copper alloy sheet. In addition, it was found that fatigue failure was extremely delayed in a material having such anisotropy.

In the X-ray diffraction profile (2 θ/θ scanning) on the rolled surface, the integrated intensity $I_{\{hkl\}}$ of each of diffraction peaks on the {111}, {200}, {220}, {311}, {331} and {420} planes is derived. Then, the ratio $P_{\{hkl\}}$ of the integrated intensity $I_{\{hkl\}}$ to the integrated intensity $I^0_{\{hkl\}}$ of pure copper powder (standard sample) which has no strain and which can be regarded as a random orientation material, i.e., the ratio $P_{\{hkl\}}=I_{\{hkl\}}/I^0_{\{hkl\}}$, is derived on each of the diffraction planes. Then, each fraction $f_{\{hkl\}}=P_{\{hkl\}}/\Sigma P_{\{hkl\}}$ is obtained so that the sum of the ratios $P_{\{hkl\}}$ on the six diffraction planes is 1. Furthermore, {hkl}={111}, {200}, {220}, {311}, {331} or {420}. These fractions indicate the degree of orientation on the low index plane which is parallel to the measured surface (rolled surface). For example, in the case of the {111} plane, the fraction $f_{\{111\}}$ is obtained by $f_{\{111\}}=P_{\{111\}}/(P_{\{111\}}+P_{\{200\}}+P_{\{220\}}+P_{\{311\}}+P_{\{331\}}+P_{\{420\}})$.

If it is supposed that crystals having each plane orientation {hkl} measured on the rolled surface by X-ray diffraction have the rolling or recrystallized textures of general copper alloys, predicted directions <uvw> parallel to the LD (the rolling direction) or the TD (the direction perpendicular to the rolling direction and thickness direction), and the Schmid factors S<uvw> assuming that each <uvw> is the tension axis, are shown in Table 1.

TABLE 1

| | | Lattice Plane {hkl} | | | | |
|---|---|---|---|---|---|---|
| | | {111} | {200} | {220} | {311} | {420} |
| LD | <uvw> | <011> | <010> | <112> | <121> | <001> |
| | S<uvw> | 0.41 | 0.41 | 0.41 | 0.41 | 0.41 |
| TD | <uvw> | <211> | <001> | <111> | <147> | <120> |
| | S<uvw> | 0.41 | 0.41 | 0.27 | 0.49 | 0.49 |

It is estimated from Table 1 that the extent of anisotropy is small in a material having high degrees of orientation on the {111} and {200} planes and that the extent of anisotropy is large in a material having high degrees of orientation on the {220}, {311} and {420} planes. Therefore, in the preferred embodiment of a copper alloy sheet according to the present invention, as a method for handling anisotropy of a rolled sheet, an index of anisotropy $Ia=\Sigma(S_{<LD\{hkl\}>}\cdot f_{\{hkl\}})/\Sigma(S_{<TD\{hkl\}>}\cdot f_{\{hkl\}})$ is utilized, assuming that the LD of a crystal having an orientation of {hkl} on the rolled surface is <LD{hkl}> and that the TD thereof is <TD{hkl}>.

Since a larger tensile stress (external force) reaches a critical shearing stress as the Schmid factor is smaller, it is considered that Ia corresponds to the relative strength of the copper alloy sheet in the TD to the strength thereof in the LD. In particular, if the above-described expression of Ia is rewritten in view of only the {220}, {311} and {420} planes on which the effects of anisotropy are strong, the rewritten expression is $Ia\approx(0.41\cdot f_{\{220\}}+0.41\cdot f_{\{311\}}+0.41\cdot f_{\{420\}}/(0.27\cdot f_{\{220\}}+0.49\cdot f_{\{311\}}+0.49\cdot f_{\{420\}})$.

This expression indicates that the total anisotropy of a polycrystalline substance is not determined by only one plane of orientation and that the contributions of the planes of orientation to the total anisotropy are different from each other. In addition, this expression approximately indicates that the sum of the peak intensities of X-ray diffraction does not have relative meaning and physical meaning, and does not have any meaning until normalization and weighting are carried out so as to convert it into the degree of orientation.

It was found that a material having a larger index of anisotropy (Ia) can be optimally utilized for spring-integrated box female terminals. However, in the orientation of a Cu—Ni—Sn—P alloy sheet obtained by usual manufacturing processes, it is not possible to sufficiently enhance the index of anisotropy (Ia). As a result, the strength of the sheet in the TD is insufficient even if the bending workability of the sheet is good, or the bending workability of the sheet is not good even if the strength of the sheet in the TD is high, so that an alloy having a good balance between the characteristics thereof has to be produced in a region wherein each of the characteristics is lower than the optimum point thereof. However, a Cu—Ni—Sn—P alloy sheet having such a texture that the index of anisotropy (Ia) is enhanced can be obtained by the preferred embodiment of a copper alloy sheet according to the present invention, which will be described below. Moreover, it was found that such a copper alloy sheet, which is thus manufactured and which has the enhanced index of anisotropy (Ia), has the function of delaying fatigue failure. It is considered that the reasons why fatigue failure is delayed are as follows. In copper alloy sheets, dislocations are generally stored in crystal boundaries while bending operations are repeated. However, in a copper alloy sheet having the enhanced index of anisotropy (Ia), the degree of crystal orientation is high to easily cause cross-slips, so that the storage of dislocation is relaxed. Thus, local work hardening is suppressed, so that fatigue failure is delayed.

It was found that such a crystal orientation can be identified by $2.9\leq Ia^{'fin.}\leq 4.0$, preferably $2.9\leq Ia^{'fin.}\leq 3.8$, assuming that the degree of orientation of a {hkl} crystal plane measured by the powder X-ray diffraction method on the rolled surface of the copper alloy sheet is $f_{\{hkl\}}$ and that $Ia^{'fin.}=(f_{\{220\}}+f_{\{311\}}+f_{\{420\}})/(0.27\cdot f_{\{220\}}+0.49\cdot f_{\{311\}}+0.49\cdot f_{\{420\}})$.

A texture satisfying this expression can not be obtained unless all of the optimum conditions and combinations of hot rolling, cold rolling and heat treatments are satisfied. In order to enhance the strength of a copper alloy sheet, it is extremely effective to carry out cold rolling after recrystallization annealing. However, both of the excellent bending workability of the sheet in the LD and the high strength of the sheet in the TD can not be obtained so as to satisfy the above-described expression only by adjusting finish cold rolling conditions. Therefore, it is desired that the copper alloy sheet has a crystal orientation satisfying $2.5\leq Ia^{'ann.}\leq 2.8$, assuming that $Ia^{'ann.}=(f_{\{220\}}+f_{\{311\}}+f_{\{420\}})/(0.27\cdot f_{\{220\}}+0.49\cdot f_{\{311\}}+0.49\cdot f_{\{420\}})$, before the finish cold rolling after the recrystallization annealing.

[Mean Grain Size]

The decrease of the mean grain size of the copper alloy is advantageous to improve the bending workability of the sheet thereof. However, if the mean grain size of the copper alloy is too small, the stress relaxation resistance of the sheet thereof is easily deteriorated, and there are some cases where the fatigue strength of the sheet thereof is deteriorated. On the other hand, if the mean grain size of the copper alloy is too large, the surface of the bent portion of the sheet thereof is easy to be rough, so that there are some cases where the bending workability and fatigue strength of the sheet thereof are deteriorated.

In addition, the degree of crystal orientation of the sheet thereof varies during recrystallization and grain growth at an annealing step. Therefore, in order to cause the texture of the sheet of the copper alloy to satisfy $2.9\leq(f_{\{220\}}+f_{\{311\}}+f_{\{420\}})/(0.27\cdot f_{\{220\}}+0.49\cdot f_{\{311\}}+0.49\cdot f_{\{420\}})\leq 4.0$ as described above and in order to maintain the satisfied level of the stress relaxation resistance of the sheet thereof even if the sheet is used for connectors for automobiles, it is required to control the grain size of the copper alloy. However, the crystal grains of the copper alloy are extended in longitudinal directions thereof by finish rolling, so that it is difficult to measure and define the grain size thereof. Therefore, the grain size is preferably limited in the recrystallization annealing before the finish rolling.

Since the mean grain size of the copper alloy after the final step is approximately determined by the grain size after the final recrystallization annealing, the annealing conditions are preferably set so as to satisfy $2.5 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 2.8$ after the recrystallization annealing as described above. Furthermore, if the grain size is less than 1 μm, the stress relaxation resistance of the copper alloy sheet is deteriorated. On the other hand, if the grain size exceeds 20 μm, the bending workability and fatigue strength of the copper alloy sheet are deteriorated. Therefore, after the heat treatment is carried out on the above-described annealing conditions, the grain size is preferably in the range of from 1 μm to 20 μm, more preferably in the range of from 1 μm to 10 μm, and most preferably in the range of form 1 μm to 5 μm.

[Characteristics]

In order to further miniaturize and thin electric and electronic parts, such as connectors, using the copper alloy sheet, the tensile strength of the sheet is preferably not less than 600 MPa, and more preferably not less than 650 MP. The electric conductivity of the copper alloy sheet is preferably 30% IACS or more, and more preferably 32.5% IACS or more.

As the evaluation of the bending workability of the copper alloy sheet, if the 90° W bending test of a bending test piece, which is cut off from the copper alloy sheet so that the longitudinal direction of the test piece is the LD (the rolling direction) of the copper alloy sheet, is carried out so that the bending axis of the test piece is the TD (the direction perpendicular to the rolling direction and thickness direction of the test piece), and if the 90° W bending test of a bending test piece, which is cut off from the copper alloy sheet so that the longitudinal direction of the test piece is the TD, is carried out so that the bending axis of the test piece is the LD, the ratio R/t of the minimum bending radius R to the thickness t of each of the test pieces for the 90° W bending test thereof in the LD and TD is preferably 1.0 or less, and more preferably 0.5 or less.

When the copper alloy sheet is used as the material of connectors for automobiles, the stress relaxation resistance in the TD is particularly important, so that the stress relaxation resistance of the sheet is preferably evaluated by a stress relaxation rate using a test piece which is so cut that the longitudinal direction thereof is the TD. The stress relaxation rate of the copper alloy sheet is preferably 10% or less, and more preferably 7% or less, when the copper alloy sheet is held at 160° C. for 1000 hours so that the maximum load stress on the surface of the copper alloy sheet is 80% of the 0.2% yield strength.

As an index indicating whether it is difficult to cause fatigue failure in a copper alloy sheet, there is a fatigue strength ratio. Throughout the specification, the "fatigue strength ratio" indicates a value obtained by dividing the upper limit of withstanding stress (fatigue strength) when completely reversed plane bending is repeated $10^7$ times, by a spring limit value. When the copper alloy sheet is used for connectors for automobiles, it is important that both of the spring limit value and the fatigue strength are high. When the connectors are miniaturized, it was found that the fatigue strength ratio in the TD for forming the spring portions of the connectors was particularly important similar to the stress relaxation resistance in order to improve the reliability thereof. Therefore, the fatigue strength ratio of the copper alloy sheet is preferably evaluated by a test piece wherein the longitudinal direction thereof is the TD. In conventional copper alloy sheets, the fatigue strength ratio is about 0.4 to 0.5. However, in accordance with the miniaturization of connectors, the fatigue strength ratio is preferably 0.55 or more, and more preferably 0.6 or more.

In order to satisfy characteristics required for electric and electronic parts, such as connectors, in recent years, it is important all of the strength, electric conductivity, bending workability, stress relaxation resistance and fatigue strength ratio of the copper alloy sheet are high levels.

[Producing Method]

The above-described sheet copper alloy sheet can be produced by the preferred embodiment of a copper alloy sheet according to the present invention. The preferred embodiment of a copper alloy sheet according to the present invention comprises: a melting and casting step of melting and casting the raw materials of a copper alloy having the above-described composition; a hot rolling step of carrying out an initial hot rolling pass in a temperature range of from 950° C. to 700° C. and carrying out a hot rolling operation in a temperature range of from less than 700° C. to 350° C.; a cold rolling step of carrying out a cold rolling operation at a rolling reduction of not less than 60% after the hot rolling step; a recrystallization annealing step of carrying out recrystallization at a temperature of 400 to 750° C. after the cold rolling step; and a finish cold rolling step of carrying out a cold rolling operation at a rolling reduction of 40 to 95% after the recrystallization annealing step. Furthermore, facing may be optionally carried out after the hot rolling step, and pickling, polishing and degreasing may be optionally carried out after each heat treatment. Moreover, the final thickness of the sheet may be adjusted by repeating the cold rolling operations and the heat treatments in that order. These steps will be described below in detail.

(Melting and Casting Step)

After the raw materials of a copper alloy are melted by the same method as a typical copper alloy melting method, an ingot may be produced by the continuous casting, semi-continuous casting or the like.

(Hot Rolling Step)

The hot rolling for Cu—Ni—Sn—P alloys is usually carried out at a high temperature of not lower than 700° C., preferably not lower than 750° C., so as to prevent precipitates from being generated during the hot rolling, and then, quenching is carried out after the hot rolling is completed. However, on such usual hot rolling conditions, it is not possible to produce a copper alloy sheet having a specific texture as the preferred embodiment of a copper alloy sheet according to the present invention. Therefore, in the preferred embodiment of a method for producing a copper alloy sheet according to the present invention, at the hot rolling step, the initial hot rolling pass is carried out in a temperature range of from 950° C. to 700° C., and the hot rolling operation is carried out in a temperature range of from less than 700° C. to 350° C. However, the copper alloy sheet after the hot rolling is required to have the precipitation state of an intermetallic compound, such as a Ni—P compound, which satisfies $3 \leq (\Sigma_{ST}-\rho_H)/\chi_P \leq 16$, assuming that the specific resistance of the copper alloy sheet after the hot rolling is $\rho_H$ (μΩ·cm), that the specific resistance of the copper alloy sheet quenched after being held at 900° C. for 30 minutes after the hot rolling is $\rho_{ST}$ (μΩ·cm), and that the concentration of P contained in the copper alloy sheet after casting is $\chi_P$ wt %.

When the hot rolling of the ingot is carried out, if the initial rolling pass is carried out in a high temperature range of not lower than 700° C. at which recrystallization is easy to occur, it is possible to break the cast structure of the ingot to uniform the components and structures thereof. However, if the hot rolling of the ingot is carried out at a high temperature exceeding 950° C., there is the possibility that cracks may be produced in portions, such as segregation portions of alloy components, at which the melting point is lowered, so that it is not preferable to carry out the hot rolling of the ingot at a high temperature exceeding 950° C. Therefore, in order to ensure the complete recrystallization during the hot rolling steps, the hot rolling operation is preferably carried out at a rolling reduction of not less than 70% in a temperature range of from 950° C. to 700° C. Thus, the uniformity of the structure of the ingot is further promoted. Furthermore, since it is required to apply a great rolling load in order to obtain a rolling reduction of not less than 70% by one pass, the total rolling reduction of not less than 70% may be ensured by a plurality of passes. In the preferred embodiment of a method for producing a copper alloy sheet according to the present invention, the rolling operation is ensured for a predetermined period of time in a temperature range of from less than 700° C. to 350, in which rolling strains are easily produced. In this case, the hot rolling operation in a temperature range of from less than 700° C. to 350° C. may be carried by a plurality of passes. The final pass temperature at the hot rolling step is preferably not lower than 350° C., and more preferably in the range of from 600° C. to 350° C. Furthermore, the rolling reduction in the temperature range of from less than 700° C. to 350° C. is preferably 55% or more, and more preferably 60% or more. The total rolling reduction at the hot rolling step may be about 85 to 95%.

The rolling reduction $\epsilon$(%) in the respective temperature range is calculated by $\epsilon=(t_0-t_1)\times100/t_0$, assuming that the thickness of the ingot before the hot rolling is $t_0$ and that the thickness of the ingot after the hot rolling is $t_1$. For example, the thickness of a plate to be subjected to the initial rolling pass in a temperature range of from 950° C. to 700° C. is 180 mm, and the hot rolling operation is carried out in a temperature range of not lower than 700° C., so that the thickness of the plate after the final rolling pass at a temperature of not lower than 700° C. is 30 mm. Then, the hot rolling operation is subsequently carried out, and the final pass of the hot rolling operation is carried out in a temperature range of from less than 700° C. to 350° C., so that the hot-rolled plate having a thickness of 10 mm is finally obtained. In this case, the rolling reduction in the temperature range of from 950° C. to 700° C. is (180−30)×100/180=83(%), and the total rolling reduction is (180−10)×100/180=94(%).

In addition, Ni—P compounds are precipitated by the hot rolling in the temperature range of from not less than 700° C. to 350° C. If the measurement of the copper alloy sheet after the hot rolling is carried out by the transmission electron microscope (TEM)—energy dispersion X-ray spectrometer, it can be found that fine Ni—P compounds are dispersed in the appropriately hot-rolled copper alloy sheet. If the amount of precipitated Ni—P compounds is insufficient at this stage, it is difficult to obtain a desired precipitation state even if a heat treatment is carried out at the subsequent step, and strain introduced at the cold rolling step before the recrystallization annealing step is insufficient, so that it is difficult to obtain a final target texture. On the other hand, if the amount of precipitated Ni—P compounds is too large, the precipitates are coarsened to have a bad influence on strain energy introduced at the cold rolling step before the recrystallization annealing step, and the bending workability of the final copper alloy sheet is deteriorated. In the preferred embodiment of a method for producing a copper alloy sheet according to the present invention, it was found that a copper alloy sheet satisfies the above-described $3\leq(\rho_{ST}-\rho_H)/\chi_P\leq16$ if the copper alloy sheet is appropriately hot-rolled so as to have target characteristics.

(Cold Rolling Step)

At the cold rolling step carried out before the recrystallization annealing, the rolling reduction is required to be not less than 60%, and is preferably not less than 70%. If the rolling reduction is less than 60%, the introduction of strain energy is insufficient, so that nucleuses for recrystallization are decreased at the next recrystallization annealing step to cause coarsening. In addition, a copper alloy sheet worked at a rolling reduction of higher than 95% is subjected to the recrystallization annealing at the next step, the above-described $2.5\leq(f_{\{220\}}+f_{\{311\}}+f_{\{420\}})/(0.27\cdot f_{\{220\}}+0.49\cdot f_{\{311\}}+0.49\cdot f_{\{420\}})\leq2.8$ is not satisfied. In particular, the recrystallized texture greatly depends on the cold rolling reduction before recrystallization, so that the rolling reduction is preferably not higher than 95%.

(Recrystallization Annealing Step)

In conventional methods for producing copper alloy sheets, the recrystallization annealing is carried out in order to recrystallize copper alloys. In the preferred embodiment of a method for producing a copper alloy sheet according to the present invention, the recrystallization annealing preferably causes the rolling texture to remain to such an extent that the recrystallized texture is not dominant in the degree of orientation after the recrystallization annealing. Such a recrystallization annealing is preferably carried out at a furnace temperature of 400 to 750° C. If the temperature is too low, recrystallization is insufficient, and if the temperature is too high, crystal grains are coarsened. In either case, it is disadvantageous to the generation of a target crystal orientation, so that it is difficult to finally obtain a high strength copper alloy sheet having an excellent bending workability. The holding time and reaching temperature in such a recrystallization annealing, which is carried out at a furnace temperature of 400 to 750° C., are preferably set so that a copper alloy sheet has a crystal orientation satisfying $2.5\leq(f_{\{220\}}+f_{\{311\}}+f_{\{420\}})/(0.27\cdot f_{\{220\}}+0.49\cdot f_{\{311\}}+0.49\cdot f_{\{420\}})\leq2.8$, assuming that the degree of orientation of a {hkl} crystal plane measured by the powder X-ray diffraction method on the rolled surface of the copper alloy sheet after the recrystallization annealing is $f_{\{hkl\}}$. Specifically, in the raw materials of a copper alloy having a chemical composition used in the preferred embodiment of a method for producing a copper alloy sheet according to the present invention, appropriate conditions may be set on heating conditions for holding the copper alloy sheet at a temperature of 400 to 750° C., preferably at a temperature of 500 to 750° C., for a few seconds to a few hours. Furthermore, there is a tendency for the above-described value of $(f_{\{220\}}+f_{\{311\}}+f_{\{420\}})/(0.27\cdot f_{\{220\}}+0.49\cdot f_{\{311\}}+0.49\cdot f_{\{420\}})$ to decrease as the quantity of heat is increased.

(Finish Cold Rolling Step)

The finish cold rolling is carried out in order to improve the strength level of the copper alloy sheet. If the finish cold-rolling reduction is too low, the work hardening of the copper alloy sheet is insufficient, so that it is difficult for the copper alloy sheet to have a sufficient strength. On the other hand, if the finish cold-rolling reduction is too high, the work hardening of the copper alloy sheet reaches the limit so as not to be caused, so that the copper alloy sheet is inextensional to be unsuitable for use as a material to be press-molded. Thus, in either case where the finish cold-rolling reduction is too low or too high, it is not possible to realize a crystal orientation wherein both of the strength and bending workability of the copper alloy sheet are high levels. In the preferred embodiment of a method for producing a copper alloy sheet according to the present invention, the finish cold-rolling reduction is preferably in the range of from 40% to 95%. By carrying out such a finish cold rolling while satisfying the above-described conditions at the respective steps, it is possible to obtain a copper alloy sheet having a crystal orientation which satisfies the above-described $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 4.0$. Furthermore, the final thickness of the copper alloy sheet is preferably in the range of from about 0.05 mm to about 1.0 mm, and more preferably in the range of from 0.08 mm to 0.5 mm, although the optimum final thickness of the copper alloy sheet varies in accordance with the use thereof.

(Low Temperature Annealing Step)

After the finish cold rolling, the low temperature annealing may be carried out so as not to change the crystal orientation after the finish cold rolling, in order to reduce the residual stress of the copper alloy sheet to improve the bending workability thereof and in order to reduce dislocation in vacancies and on the slip plane to improve the stress relaxation resistance of the copper alloy sheet. The heating temperature in the low temperature annealing is preferably set so that the temperature of the material is in the range of from 150° C. to 450° C. This low temperature annealing has the function of improving the bending workability and stress relaxation resistance of the copper alloy sheet without substantially lowering the strength thereof, and also has the function of enhancing the electric conductivity of the copper alloy sheet. If the heating temperature in the low temperature annealing is too high, the copper alloy sheet is softened in a short time, so that variations in characteristics are easily caused in either of batch and continuous systems. On the other hand, if the heating temperature is too low, it is not possible to sufficiently obtain the above-described functions of improving the characteristics. The holding time in the above-described temperature range is preferably not less than 5 seconds in view of stability in the case of a continuous system, and not longer than 10 hours in view of costs in the case of a batch system.

Between the finish cold rolling and the low temperature annealing or after the low temperature annealing, the copper alloy sheet may be caused to pass through a tension leveler to correct the shape thereof. However, when the copper alloy sheet is caused to pass through the tension leveler after the low temperature annealing, it is required to prevent variations in characteristics, such as a spring limit value.

The examples of copper alloy sheets and methods for producing the same according to the present invention will be described below in detail.

Examples 1-8

There were melted a copper alloy containing 0.90 wt % of Ni, 1.44 wt % of Sn, 0.071 wt % of P and the balance being Cu (Example 1), a copper alloy containing 2.15 wt % of Ni, 1.35 wt % of Sn, 0.092 wt % of P, 0.10 wt % of Cr, 0.05 wt % of Zr and the balance being Cu (Example 2), a copper alloy containing 2.27 wt % of Ni, 1.86 wt % of Sn, 0.074 wt % of P, 0.05 wt % of Co, 0.005 wt % of B and the balance being Cu (Example 3), a copper alloy containing 0.66 wt % of Ni, 1.70 wt % of Sn, 0.120 wt % of P, 0.08 wt % of Mg, 0.09 wt % of Ti and the balance being Cu (Example 4), a copper alloy containing 1.06 wt % of Ni, 0.79 wt % of Sn, 0.038 wt % of P, 0.03 wt % of Si, 0.11 wt % of Mn and the balance being Cu (Example 5), 0.74 wt % of Ni, 1.40 wt % of Sn, 0.090 wt % of P, 0.32 wt % of Zn, 0.10 wt % of V and the balance being Cu (Example 6), a copper alloy containing 1.04 wt % of Ni, 0.90 wt % of Sn, 0.056 wt % of P, 0.036 wt % of Zn, 0.06 wt % of Fe and the balance being Cu (Example 7), a copper alloy containing 0.97 wt % of Ni, 1.51 wt % of Sn, 0.08 wt % of P, 0.026 wt % of Zn and the balance being Cu (Example 8), respectively. Then, a vertical continuous casting machine was used for casting the melted copper alloys to obtain ingots having a thickness of 180 mm, respectively.

Each of the ingots was heated to 920° C., and then, extracted to start hot rolling. The pass schedule in the hot rolling was set so that the rolling reduction in a temperature range of from 950° C. to 700° C. was not less than 70% while the hot rolling was carried out even in a temperature range of lower than 700° C. Furthermore, the hot-rolling reduction in the temperature range of from less than 700° C. to 350° C. was 67% (Examples 1, 4, 5, 7 and 8), 73% (Example 2), 62% (Example and 6), respectively, and the final pass temperature in the hot rolling was a temperature of 600 to 350° C. The total hot-rolling reduction from the ingot was about 94%. After the hot rolling, the surface oxide layer was mechanically removed (faced). Furthermore, the value of $(\rho_{ST}-\rho_H)/\chi_P$ indicating the precipitation state after the hot rolling was 9.3 (Example 1), 15.0 (Example 2), 5.9 (Example 3), 9.5 (Example 4), 10.0 (Example 5), 4.3 (Example 6), 6.7 (Example 7) and 9.0 (Example 8), respectively, all of which satisfied $3 \leq (\rho_{ST}-\rho_H)/\chi_P \leq 16$.

Then, the cold rolling for adjusting the thickness of a plate of the copper alloy was carried out at a rolling reduction of 72% (Examples 1, 2, and 6), 73% (Example 3), 61% (Example 5), 0% (Example 7) and 78% (Example 8), respectively, and then, a heat treatment was carried out at 550° C. for about three hours to carry out recrystallization in the respective examples except for Example 7.

Then, the cold rolling was carried out at a rolling reduction of 85% (Examples 1, 6 and 7), 87% (Examples 2 and 8), 83% (Examples 3 and 4) and 72% (Example 5), respectively, and then, recrystallization was carried out at a temperature of 650 to 750° C. for 10 to 60 seconds. With respect to the recrystallization annealing temperature and time in each example, the reaching temperature was adjusted in the range of from 650° C. to 750° C. in accordance with the composition of each of the alloys, and the holding time in the temperature range of 650° C. to 750° C. was adjusted in the range of from 10 seconds to 60 seconds so that $Ia'^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was in the range of from 2.5 to 2.8. Furthermore, the value of $Ia'^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was 2.69 (Example 1), 2.73 (Example 2), 2.77 (Example 3), 2.64 (Example 4), 2.55 (Example 5), 2.52 (Example 6), 2.62 (Example 7) and 2.63 (Example 8), respectively, all of which satisfied $2.5 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 2.8$.

Then, each of the copper alloy sheets after the final recrystallization annealing was finish cold-rolled at a rolling reduction of 61% (Examples 1 and 6), 55% (Example 2), 65% (Examples 3 and 4), 85% (Example 5), 90% (Example 7) and 42% (Example 8), respectively. Then, a low temperature annealing for charging each of the copper alloy sheets in an annealing furnace at 400° C. for five minutes was carried out.

The copper alloy sheets were thus obtained in Examples 1-8. Furthermore, facing was optionally carried out in the middle of the production of the copper alloy sheets so that the thickness of each of the copper alloy sheets was 0.15 mm.

Then, samples were cut out from the copper alloy sheets obtained in these examples, to derive the mean grain size, intensity of X-ray diffraction, tensile strength, electric conductivity, bending workability, stress relaxation resistance, and fatigue strength ratio of each of the copper alloy sheets as follows.

The mean grain size of the copper alloy sheet was derived in accordance with the method of section based on JIS H0501, by observing the surface (rolled surface) of the copper alloy sheet by means of an optical microscope after polishing and etching the surface thereof. As a result, the mean grain size of the copper alloy sheet was less than 5 μm (Examples 1-4, 7 and 8), 5.1 μm (Example 5), and 8.7 μm (Example 6), respectively.

The intensity of X-ray diffraction (the integrated intensity of X-ray diffraction) on the surface (rolled surface) of the copper alloy sheet was measured by means of an X-ray diffractometer (XRD) on the measuring conditions which contain Mo-Kα rays, an X-ray tube voltage of 40 kV and an X-ray tube current of 30 mA. In the X-ray diffraction profile (2 θ/θ scanning) thus measured, the integrated intensity $I_{\{hkl\}}$ of each of diffraction peaks on the {111}, {200}, {220}, {311}, {331} and {420} planes was obtained. In addition, the integrated intensity $I^0_{\{hkl\}}$ of pure copper powder (standard sample) having no strain and capable of being regarded as a random orientation material was obtained by means of the same X-ray diffractometer on the same measuring conditions. Then, the ratio $P_{\{hkl\}}=I_{\{hkl\}}/I^0_{\{hkl\}}$ was obtained on each of the diffraction planes, and each fraction $f_{\{hkl\}}=P_{\{hkl\}}/\Sigma P_{\{hkl\}}$ was obtained so that the sum of the ratios $P_{\{hkl\}}$ on the six diffraction planes was 1. Assuming that each fraction $f_{\{hkl\}}$ was the degree of orientation on a corresponding one of the crystal planes, $Ia^{fin.}=(f_{\{220\}}+f_{\{311\}}+f_{\{420\}})/(0.27\cdot f_{\{220\}}+0.49\cdot f_{\{311\}}+0.49\cdot f_{\{420\}})$ indicating the degree of crystal orientation of the obtained copper alloy sheet was obtained. As a result, $Ia^{fin.}=(f_{\{220\}}+f_{\{311\}}+f_{\{420\}})/(0.27\cdot f_{\{220\}}+0.49\cdot f_{\{311\}}+0.49\cdot f_{\{420\}})$ indicating the degree of crystal orientation of the obtained copper alloy sheet was 3.07 (Example 1), 3.03 (Example 2), 3.21 (Example 3), 3.15 (Example 4), 2.99 (Example 5), 2.96 (Example 6), 3.52 (Example 7) and 2.98 (Example 8), respectively, all of which satisfied $2.9\leq(f_{\{220\}}+f_{\{311\}}+f_{\{420\}})/(0.27\cdot f_{\{220\}}+0.49\cdot f_{\{311\}}+0.49\cdot f_{\{420\}})\leq 4.0$.

In order to evaluate the tensile strength serving as one of mechanical characteristics of the copper alloy sheet, three test pieces (No. 5 test pieces based on JIS Z2201) for tensile test in the TD (the direction perpendicular to the rolling direction and thickness direction) were cut out from the copper alloy sheet. Then, the tensile test based on JIS 22241 was carried out with respect to each of the test pieces to derive the tensile strength of the copper alloy sheet in the TD by the mean value of tensile strengths of the three test pieces. As a result, the tensile strength of the copper alloy sheet in the TD was 649 MPa (Example 1), 631 MPa (Example 2), 664 MPa (Example 3), 677 MPa (Example 4), 629 MPa (Example 5), 652 MPa (Example 6), 707 MPa (Example 7) and 605 MPa (Example 8), respectively.

The electric conductivity of the copper alloy sheet was measured in accordance with the electric conductivity measuring method based on JIS H0505. As a result, the electric conductivity of the copper alloy sheet was 34.2% IACS (Example 1), 32.1% IACS (Example 2), 30.5% IACS (Example 3), 38.8% IACS (Example 4), 39.1% IACS (Example 5), 37.3% IACS (Example 6), 41.0% IACS (Example 7) and 34.3% IACS (Example 8), respectively.

In order to evaluate the bending workability of the copper alloy sheet, three bending test pieces (width: 10 mm) having a longitudinal direction of LD (rolling direction) were cut out from the copper alloy sheet. Then, the 90° W bending test based on JIS H3110 was carried out with respect to each of the test pieces. Then, the surface and section of the bent portion of each of the test pieces after the test were observed at a magnification of 24 (a magnification of 100 if necessary) by means of an optical microscope, to derive a minimum bending radius R at which cracks are not produced. Then, the minimum bending radius R was divided by the thickness t of the copper alloy sheet, to derive the value of R/t in the LD. The worst result of the values of R/t with respect to the three test pieces in the LD was adopted as the value of R/t in the LD. As a result, the value of R/t in the LD was 0.0 (Examples 1-6 and 8) and 0.3 (Example 7), respectively. It can be judged that a copper ally sheet has an excellent bending workability if the value of R/t thereof is not greater than 0.5.

In order to evaluate the stress relaxation resistance of the copper alloy sheet, a bending test piece (width: 10 mm) having a longitudinal direction of TD (the direction perpendicular to the rolling direction and thickness direction) was cut out from the copper alloy sheet. Then, the bending test piece was bent in the form of an arch so that the surface stress in the central portion of the test piece in the longitudinal direction thereof was 80% of the 0.2% yield strength, and then, the test piece was fixed in this state. Furthermore, the surface stress is defined by surface stress (MPa)$=6Et\delta/L_0^2$ wherein E denotes the modulus of elasticity (MPa), and t denotes the thickness (mm) of the sample, δ denoting the deflection height (mm) of the sample. From the bending deformation after the test piece in this state was held at 150° C. for 1000 hours in the atmosphere, the stress relaxation rate was calculated by stress relaxation rate (%)$=(L_1-L_2)\times 100/(L_1-L_0)$ wherein $L_0$ denotes the length of a jig, i.e., the horizontal distance (mm) between both ends of the fixed sample during the test, and $L_1$ denotes the length (mm) of the sample when the test starts, $L_2$ denoting the horizontal distance (mm) between both ends of the sample after the test. As a result, the stress relaxation rate was 4.9% (Example 1), 6.8% (Example 2), 6.9% (Example 3), 3.3% (Example 4), 2.9% (Example 5), 2.8% (Example 6), 6.2% (Example 7) and 4.8% (Example 8), respectively. It can be evaluated that the copper alloy sheet having a stress relaxation rate of not higher than 7% has a high durability even if the copper alloy sheet is used as the material of connectors for automobiles.

In order to evaluate the fatigue strength of the copper alloy sheet, a test piece having a longitudinal direction of TD (the direction perpendicular to the rolling direction and thickness direction) was cut out from the copper alloy sheet, and a fatigue test based on JIS 22273 was carried out with respect to the test piece. In this fatigue test, the fatigue limit under completely reversed plane bending was measured to derive the fatigue strength ratio of the test piece from a stress value withstanding the completely reversed plane bending repeated $10^7$ times. Throughout the specification, the "fatigue strength ratio" means a value obtained by dividing a fatigue limit by a spring limit value which is obtained by a moment type spring limit value test based on JIS H3130, although it generally means a value obtained by dividing a fatigue limit by a tensile strength. As a result, the fatigue strength ratio was 0.62 (Example 1), 0.59 (Examples 2 and 7), 0.60 (Example 3), 0.64 (Examples 4 and 6), 0.65 (Example 5) and 0.66 (Example 8), respectively.

Comparative Example 1

A copper alloy sheet was obtained by the same method as that in Example 1, except that the cold-rolling reduction for adjusting the thickness of the sheet was 18%, that the cold-rolling reduction before the final recrystallization annealing was 96%, that $Ia^{ann.}=(f_{\{220\}}+f_{\{311\}}+f_{\{420\}})/(0.27\cdot f_{\{220\}}+$ $0.49 \cdot f_{\{311\}}+0.49 \cdot f_{\{420\}}$) indicating the degree of crystal orientation after the final recrystallization annealing was 2.20 and that the finish cold-rolling reduction was 50%. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was 15 μm, and $Ia^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 2.56. The tensile strength in the TD was 568 MPa, and the electric conductivity was 32.1% IACS. The ratio R/t in the LD was 0.0, and the stress relaxation rate was 4.8%. The fatigue strength ratio was 0.53.

Comparative Example 2

A copper alloy sheet was obtained by the same method as that in Example 8, except that the finish cold-rolling reduction was 34% and that the facing amount for adjusting the thickness of the sheet was varied. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was less than 5 μm, and $Ia^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 2.82. The tensile strength in the TD was 580 MPa, and the electric conductivity was 35.8% IACS. The ratio R/t in the LD was 0.0, and the stress relaxation rate was 4.6%. The fatigue strength ratio was 0.52.

Comparative Example 3

A copper alloy sheet was obtained by the same method as that in Example 8, except that the cold-rolling reduction before the final recrystallization annealing was 55%, that $Ia'^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was 2.38, that the finish cold-rolling reduction was 81%, and that the facing amount for adjusting the thickness of the sheet was varied. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was 10 μm, and $Ia^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 2.84. The tensile strength in the TD was 610 MPa, and the electric conductivity was 34.2% IACS. The ratio R/t in the LD was 0.7, and the stress relaxation rate was 3.0%. The fatigue strength ratio was 0.51.

Comparative Example 4

A copper alloy sheet was obtained by the same method as that in Example 5, except that the hot-rolling reduction in the temperature range of from less than 700° C. to 350° C. was 50%, that $(\rho_{ST}-\rho_H)/\chi_P$ indicating the precipitation state after the hot rolling was 1.3, that the cold-rolling reduction for adjusting the thickness of the sheet was 72%, that the cold-rolling reduction before the final recrystallization annealing was 85%, that $Ia'^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was 2.44, and that the finish cold-rolling reduction was 60%. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was 15 μm, and $Ia'^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 2.83. The tensile strength in the TD was 607 MPa, and the electric conductivity was 40.1% IACS. The ratio R/t in the LD was 0.0, and the stress relaxation rate was 5.4%. The fatigue strength ratio was 0.49.

Comparative Example 5

A copper alloy sheet was obtained by the same method as that in Example 4, except that the hot-rolling reduction in the temperature range of from less than 700° C. to 350° C. was 80%, that $(\rho_{ST}-\rho_H)/\chi_P$ indicating the precipitation state after the hot rolling was 17.5, that the cold-rolling reduction for adjusting the thickness of the sheet was 68%, that the cold-rolling reduction before the final recrystallization annealing was 87%, that $Ia'^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was 2.78, and that the finish cold-rolling reduction was 60%. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was less than 5 μm, and $Ia'^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 2.81. The tensile strength in the TD was 650 MPa, and the electric conductivity was 35.3% IACS. The ratio R/t in the LD was 0.7, and the stress relaxation rate was 10.2%. The fatigue strength ratio was 0.50.

Comparative Example 6

A copper alloy sheet was obtained by the same method as that in Example 1, except that the cold-rolling reduction for adjusting the thickness of the sheet was 0%, that the heat treatment after the cold rolling for adjusting the thickness of the sheet was omitted, that the cold-rolling reduction before the final recrystallization annealing was 83%, that $Ia'^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was 2.58, that the finish cold-rolling reduction was 96%, and that the final thickness of the sheet was 0.08 mm. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was 5 μm, and $Ia'^{fin.}=(f_{\{220\}}+f_{\{311\}}+f_{\{420\}})/$ $(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 4.05. The tensile strength in the TD was 710 MPa, and the electric conductivity was 31.8% IACS. The ratio R/t in the LD was 1.8, and the stress relaxation rate was 8.3%. The fatigue strength ratio was 0.49.

Comparative Example 7

A copper alloy sheet was obtained by the same method as that in Example 8, except that the cold-rolling reduction for adjusting the thickness of the sheet was 68%, that $Ia^{ann.}=(f_{\{220\}})+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was 2.91, and that the finish cold-rolling reduction was 60%. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was less than 5 μm, and $Ia^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 4.07. The tensile strength in the TD was 730 MPa, and the electric conductivity was 32.7% IACS. The ratio R/t in the LD was 2.6, and the stress relaxation rate was 13.8%. The fatigue strength ratio was 0.48.

Comparative Example 8

A copper alloy sheet was obtained by the same method as that in Example 1, except that a copper alloy containing 0.08 wt % of Ni, 0.09 wt % of Sn, 0.100 wt % of P, 0.21 wt % of Zn and the balance being Cu was used as the melted copper alloy, that the hot-rolling reduction in the temperature range of from less than 700° C. to 350° C. was 62%, that $(\rho_{ST}-\rho_H)/\chi_P$ indicating the precipitation state after the hot rolling was 1.5, that the cold-rolling reduction for adjusting the thickness of the sheet was 0%, that the heat treatment after the cold rolling for adjusting the thickness of the sheet was omitted, that the cold-rolling reduction before the final recrystallization annealing was 89%, that $Ia^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was 2.61, and that the finish cold-rolling reduction was 86%. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was 9.8 μm, and $Ia^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 2.91. The tensile strength in the TD was 458 MPa, and the electric conductivity was 67.4% IACS. The ratio R/t in the LD was 0.0, and the stress relaxation rate was 13.2%. The fatigue strength ratio was 0.55.

Comparative Example 9

A copper alloy containing 1.06 wt % of Ni, 0.78 wt % of Sn, 0.710 wt % of P, 0.03 wt % of Si, 0.11 wt % of Mn and the balance being Cu was used as the melted copper alloy to be cast by the same method as that in Example 1 for obtaining an ingot. When the ingot thus obtained was hot-rolled, cracks are produced, so that it was not possible to prepare any sample capable of being finally evaluated. Furthermore, in this comparative example, $(\rho_{ST}-\rho_H)/\chi_P$ indicating the precipitation state after the hot rolling was 1.8.

Comparative Example 10

A copper alloy sheet was obtained by the same method as that in Example 1, except that a copper alloy containing 1.06 wt % of Ni, 5.30 wt % of Sn, 0.038 wt % of P, 0.03 wt % of Si, 0.11 wt % of Mn and the balance being Cu was used as the melted copper alloy, that $(\rho_{ST}-\rho_H)/\chi_P$ indicating the precipitation state after the hot rolling was 6.1, and that $Ia^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final recrystallization annealing was 2.56. Samples were cut out from the copper alloy sheet obtained in this comparative example, to derive the mean grain size, intensity of X-ray diffraction, tensile strength, electric conductivity, bending workability, stress relaxation resistance, and fatigue strength ratio thereof by the same methods as those in Examples 1-8. As a result, the mean grain size was less than 5 μm, and $Ia^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation of the copper alloy sheet obtained from the intensity of X-ray diffraction was 2.93. The tensile strength in the TD was 702 MPa, and the electric conductivity was 17.5% IACS. The ratio R/t in the LD was 1.0, and the stress relaxation rate was 9.1%. The fatigue strength ratio was 0.56.

The compositions, producing conditions, structures and characteristics in the examples and comparative examples are shown in Tables 2-6.

TABLE 2

| | Chemical Composition (wt %) | | | | |
|---|---|---|---|---|---|
| | Cu | Ni | Sn | P | others |
| Ex. 1 | bal. | 0.90 | 1.44 | 0.071 | — |
| Ex. 2 | bal. | 2.15 | 1.35 | 0.092 | Cr: 0.1, Zr: 0.05 |
| Ex. 3 | bal. | 2.27 | 1.86 | 0.074 | Co: 0.05, B: 0.005 |
| Ex. 4 | bal. | 0.66 | 1.70 | 0.120 | Mg: 0.08, Ti: 0.09 |
| Ex. 5 | bal. | 1.06 | 0.79 | 0.038 | Si: 0.03, Mn: 0.11 |
| Ex. 6 | bal. | 0.74 | 1.40 | 0.090 | Zn: 0.32, V: 0.10 |
| Ex. 7 | bal. | 1.04 | 0.90 | 0.056 | Zn: 0.036, Fe: 0.06 |
| Ex. 8 | bal. | 0.97 | 1.51 | 0.080 | Zn: 0.026 |
| Comp. 1 | bal. | 0.90 | 1.44 | 0.071 | — |
| Comp. 2 | bal. | 0.97 | 1.51 | 0.080 | Zn: 0.026 |
| Comp. 3 | bal. | 0.97 | 1.51 | 0.080 | Zn: 0.026 |
| Comp. 4 | bal. | 1.06 | 0.79 | 0.038 | Si: 0.03, Mn: 0.11 |
| Comp. 5 | bal. | 0.66 | 1.70 | 0.120 | Mg: 0.08, Ti: 0.09 |
| Comp. 6 | bal. | 0.90 | 1.44 | 0.071 | — |
| Comp. 7 | bal. | 0.97 | 1.51 | 0.080 | Zn: 0.026 |
| Comp. 8 | bal. | 0.08 | 0.09 | 0.100 | Zn: 0.21 |
| Comp. 9 | bal. | 1.06 | 0.78 | 0.710 | Si: 0.03, Mn: 0.11 |
| Comp. 10 | bal. | 1.06 | 5.30 | 0.038 | Si: 0.03, Mn: 0.11 |

TABLE 3

| | Hot Rolling | |
|---|---|---|
| | Rolling Reduction(%) in temperatures ranging from less than 700° C. to 350° C. | Precipitation State after Hot Rolling $\frac{\rho_{ST}-\rho_H}{x_P}$ |
| Ex. 1 | 67 | 9.3 |
| Ex. 2 | 73 | 15.0 |
| Ex. 3 | 62 | 5.9 |

TABLE 3-continued

| | Hot Rolling | |
|---|---|---|
| | Rolling Reduction(%) in temperatures ranging from less than 700° C. to 350° C. | Precipitation State after Hot Rolling $\frac{\rho_{ST}-\rho_H}{x_P}$ |
| Ex. 4 | 67 | 9.5 |
| Ex. 5 | 67 | 10.0 |
| Ex. 6 | 62 | 4.3 |
| Ex. 7 | 67 | 6.7 |
| Ex. 8 | 67 | 9.0 |
| Comp. 1 | 67 | 9.3 |
| Comp. 2 | 67 | 9.0 |
| Comp. 3 | 67 | 9.0 |
| Comp. 4 | 50 | 1.3 |
| Comp. 5 | 80 | 17.5 |
| Comp. 6 | 67 | 9.3 |
| Comp. 7 | 67 | 9.0 |
| Comp. 8 | 62 | 1.5 |

TABLE 3-continued

| | Hot Rolling | |
|---|---|---|
| | Rolling Reduction(%) in temperatures ranging from less than 700° C. to 350° C. | Precipitation State after Hot Rolling $\frac{\rho_{ST}-\rho_H}{x_P}$ |
| Comp. 9 | 67 | 1.8 |
| Comp. 10 | 67 | 6.1 |

TABLE 4

| | Cold-rolling Reduction(%) before Final Recrystal-ization Annealing | Degree of Crystal Orientation after Final Recrystallization Annealing $\frac{f_{\{220\}}+f_{\{311\}}+f_{\{420\}}}{0.27\cdot f_{\{220\}}+0.49\cdot f_{\{311\}}+0.49\cdot f_{\{420\}}}$ |
|---|---|---|
| Ex. 1 | 85 | 2.69 |
| Ex. 2 | 87 | 2.73 |

TABLE 4-continued

| | Cold-rolling Reduction(%) before Final Recrystal-ization Annealing | Degree of Crystal Orientation after Final Recrystallization Annealing $\frac{f_{\{220\}}+f_{\{311\}}+f_{\{420\}}}{0.27\cdot f_{\{220\}}+0.49\cdot f_{\{311\}}+0.49\cdot f_{\{420\}}}$ |
|---|---|---|
| Ex. 3 | 83 | 2.77 |
| Ex. 4 | 83 | 2.64 |
| Ex. 5 | 72 | 2.55 |
| Ex. 6 | 85 | 2.52 |
| Ex. 7 | 85 | 2.62 |
| Ex. 8 | 87 | 2.63 |
| Comp. 1 | 96 | 2.20 |
| Comp. 2 | 87 | 2.63 |
| Comp. 3 | 55 | 2.38 |
| Comp. 4 | 85 | 2.44 |
| Comp. 5 | 87 | 2.78 |
| Comp. 6 | 83 | 2.58 |
| Comp. 7 | 87 | 2.91 |
| Comp. 8 | 89 | 2.61 |
| Comp. 9 | N.A. | N.A. |
| Comp. 10 | 85 | 2.56 |

TABLE 5

| | Rolling Reduction(%) in Finish Cold Rolling | Crystal Orientation after Final Step $\frac{f_{\{220\}}+f_{\{311\}}+f_{\{420\}}}{0.27\cdot f_{\{220\}}+0.49\cdot f_{\{311\}}+0.49\cdot f_{\{420\}}}$ | Mean Grain Size after Final Step |
|---|---|---|---|
| Ex. 1 | 61 | 3.07 | less than 5 μm |
| Ex. 2 | 55 | 3.03 | less than 5 μm |
| Ex. 3 | 65 | 3.21 | less than 5 μm |
| Ex. 4 | 65 | 3.15 | less than 5 μm |
| Ex. 5 | 85 | 2.99 | 5.1 μm |
| Ex. 6 | 61 | 2.96 | 8.7 μm |
| Ex. 7 | 90 | 3.52 | less than 5 μm |
| Ex. 8 | 42 | 2.98 | less than 5 μm |
| Comp. 1 | 50 | 2.56 | 15 μm |
| Comp. 2 | 34 | 2.82 | less than 5 μm |
| Comp. 3 | 81 | 2.84 | 10 μm |
| Comp. 4 | 60 | 2.83 | 15 μm |
| Comp. 5 | 60 | 2.81 | less than 5 μm |
| Comp. 6 | 96 | 4.05 | less than 5 μm |
| Comp. 7 | 60 | 4.07 | less than 5 μm |
| Comp. 8 | 86 | 2.91 | 9.8 μm |
| Comp. 9 | N.A. | N.A. | N.A. |
| Comp. 10 | 61 | 2.93 | less than 5 μm |

TABLE 6

| | Characteristics | | | | |
|---|---|---|---|---|---|
| | Tensile Strength (MPa) TD | Electric Conductivity (% IACS) | Bending Workability (R/t) LD | Stress Relaxation Rate(%) TD | Fatigue Strength Ratio TD |
| Ex. 1 | 649 | 34.2 | 0.0 | 4.9 | 0.62 |
| Ex. 2 | 631 | 32.1 | 0.0 | 6.8 | 0.59 |
| Ex. 3 | 664 | 30.5 | 0.0 | 6.9 | 0.60 |
| Ex. 4 | 677 | 38.8 | 0.0 | 3.3 | 0.64 |
| Ex. 5 | 629 | 39.1 | 0.0 | 2.9 | 0.65 |
| Ex. 6 | 652 | 37.3 | 0.0 | 2.8 | 0.64 |
| Ex. 7 | 707 | 41.0 | 0.3 | 6.2 | 0.59 |
| Ex. 8 | 605 | 34.3 | 0.0 | 4.8 | 0.66 |
| Comp. 1 | 568 | 32.1 | 0.0 | 4.8 | 0.53 |
| Comp. 2 | 580 | 35.8 | 0.0 | 4.6 | 0.52 |
| Comp. 3 | 610 | 34.2 | 0.7 | 3.0 | 0.51 |
| Comp. 4 | 607 | 40.1 | 0.0 | 5.4 | 0.49 |
| Comp. 5 | 650 | 35.3 | 0.7 | 10.2 | 0.50 |
| Comp. 6 | 710 | 31.8 | 1.8 | 8.3 | 0.49 |
| Comp. 7 | 730 | 32.7 | 2.6 | 13.8 | 0.48 |

TABLE 6-continued

| | Characteristics | | | | |
|---|---|---|---|---|---|
| | Tensile Strength (MPa) TD | Electric Conductivity (% IACS) | Bending Workability (R/t) LD | Stress Relaxation Rate(%) TD | Fatigue Strength Ratio TD |
| Comp. 8 | 458 | 67.4 | 0.0 | 13.2 | 0.55 |
| Comp. 9 | N.A. | N.A. | N.A. | N.A. | N.A. |
| Comp. 10 | 702 | 17.5 | 1.0 | 9.1 | 0.56 |

As can be seen from Tables 5 and 6, all of the copper alloy sheets in Examples 1-8 have a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 4.0$, an electric conductivity of not less than 30% IACS, such a high strength that the tensile strength in the TD is not less than 600 MPa, such an excellent bending workability that the value of R/t in the LD is not greater than 0.5, such an excellent stress relaxation resistance that the stress relaxation rate in the TD, which is important when the sheets are used for connectors for automobiles, is not higher than 7%, and such an excellent fatigue strength that the fatigue strength ratio is not less than 0.55.

On the other hand, the copper alloy sheets in Comparative Examples 1-7 were produced from the raw materials of copper alloys having the same compositions as those in Examples 1, 4, 5 and 8, by different producing conditions from those in Examples 1-8. In all of the copper alloy sheets in these comparative examples, $Ia^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ was beyond the limits of from 2.9 to 4.0, and the fatigue strength ratio was less than 0.55, so that all characteristics of strength, bending workability, stress relaxation resistance and fatigue strength ratio were not satisfied. In the copper alloy sheet in Comparative Example 1, the cold-rolling reduction before the final recrystallization annealing was too high, and the final recrystallization annealing conditions were super annealing conditions, so that $Ia^{ann.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ was lower than 2.5. Therefore, it was not possible to obtain good characteristics, and the strength was lowered. On the other hand, in the copper alloy sheet in Comparative Example 3, the cold-rolling reduction before the final recrystallization annealing was insufficient, and $Ia^{ann.}$ indicating the degree of crystal orientation after the final recrystallization annealing was less than 2.5, so that $Ia^{fin.}=(f_{\{220\}}+f_{\{311\}}+f_{\{420\}})/(0.27 \cdot f_{\{220\}}+0.49 \cdot f_{\{311\}}+0.49 \cdot f_{\{420\}})$ indicating the degree of crystal orientation after the final step was also less than 2.9. In Comparative Example 3, the bending workability was lowered although the finish rolling reduction was set to be high in order to cause the strength of the sheet to be a target value of 600 MPa. In the copper alloy sheet in Comparative Example 2, the finish rolling reduction was too low, so that $Ia^{fin.}$ indicating the degree of crystal orientation after the final step was less than 2.9 while the strength was insufficient. In the copper alloy sheet in Comparative Example 4, the hot rolling reduction and hot rolling time in the temperature range of from less than 700° C. to 350° C. were insufficient, so that the amount of precipitates was insufficient. Therefore, the subsequent cold rolling and annealing did not cause $Ia^{ann.}$ indicating the degree of crystal orientation after the final recrystallization annealing to reach 2.5, so that $Ia^{fin.}$ indicating the degree of crystal orientation after the final step did not reach 2.9. In the copper alloy sheet in Comparative Example 5, since the hot rolling in the temperature range of from less than 700° C. to 350° C. was carried out in a long time so as to excessively form precipitates, $Ia^{fin.}$ indicating the degree of crystal orientation after the final step was low while all of the bending workability, stress relaxation resistance and fatigue strength ratio were not good. In the copper alloy sheet in Comparative Example 6, the finish rolling reduction was too high, and $Ia^{fin.}$ indicating the degree of crystal orientation after the final step exceeded 4.0, so that all of the bending workability, stress relaxation resistance and fatigue strength ratio were not good although the strength was sufficient. In the copper alloy sheet in Comparative Example 7, the final recrystallization annealing conditions were inadequate, and $Ia^{ann.}$ indicating the degree of crystal orientation after the final recrystallization annealing exceeded 2.8, so that all of the bending workability, stress relaxation resistance and fatigue strength ratio were not good.

In the copper alloy sheets in Comparative Examples 8-10, the contents of Ni, Sn and/or P were beyond the limits, so that good characteristics were not obtained. In the copper alloy sheet in Comparative Example 8, since the contents of Ni and Sn were too low, the strength level was low, so that it was not possible to improve the strength even if Zn was added. In addition, in Comparative Example 8, the amount of precipitates after the hot rolling was small, and there is a tendency for crystal grains to be easily coarsened, but the stress relaxation resistance was deteriorated. In Comparative Example 9, since the amount of P was too high, cracks were produced in the middle of the hot rolling, so that it was not possible to prepare any sample capable of being finally evaluated. In the copper alloy sheet in Comparative Example 10, since the content of Sn was too high, although the tensile strength was high, the electric conductivity was low, and the bending workability and stress relaxation resistance were not good.

The invention claimed is:

1. A copper alloy sheet which has a thickness of 0.05 to 1.0 mm and a mean grain size of 1 to 10 μm and which has a chemical composition consisting of 0.1 to 5 wt % of nickel, 0.1 to 5 wt % of tin, 0.01 to 0.5 wt % of phosphorus and the balance being copper and unavoidable impurities, said copper alloy sheet having a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 4.0$, assuming that the degree of orientation of a {hkl} crystal plane measured by the powder X-ray diffraction method on the rolled surface of the copper alloy sheet is $f_{\{hkl\}}$.

2. A copper alloy sheet which has a thickness of 0.05 to 1.0 mm and a mean grain size of 1 to 10 μm and which has a chemical composition consisting of:

0.1 to 5 wt % of nickel;

0.1 to 5 wt % of tin;

0.01 to 0.5 wt % of phosphorus;

one or more elements which are selected from the group consisting of 3 wt % or less of iron, 5 wt % or less of zinc, 1 wt % or less of magnesium, 0.03 wt % or less of silicon and 2 wt % or less of cobalt; and the balance being copper and unavoidable impurities, said copper alloy sheet having a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}} \leq 4.0$, assuming that the degree of orientation of a {hkl} crystal plane measured by the powder X-ray diffraction method on the rolled surface of the copper alloy sheet is $f_{\{hkl\}}$.

3. A copper alloy sheet which has a thickness of 0.05 to 1.0 mm and a mean grain size of 1 to 10 μm and which has a chemical composition consisting of:

0.1 to 5 wt % of nickel;

0.1 to 5 wt % of tin;

0.01 to 0.5 wt % of phosphorus;

one or more elements which are selected from the group consisting of chromium, boron, zirconium, titanium, manganese and vanadium, the total amount of these elements being 3 wt % or less; and the balance being copper and unavoidable impurities, said copper alloy sheet having a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 4.0$, assuming that the degree of orientation of a {hkl} crystal plane measured by the powder X-ray diffraction method on the rolled surface of the copper alloy sheet is $f_{\{hkl\}}$.

4. A copper alloy sheet which has a thickness of 0.5 to 1.0 mm and a mean grain size of 1 to 10 μm and which has a chemical composition consisting of:

0.1 to 5 wt % of nickel;

0.1 to 5 wt % of tin;

0.01 to 0.5 wt % of phosphorus;

one or more elements which are selected from the group consisting of 3 wt % or less of iron, 5 wt % or less of zinc, 1 wt % or less of magnesium, 0.03 wt % or less of silicon and 2 wt % or less of cobalt;

one or more elements which are selected from the group consisting of chromium, boron, zirconium, titanium, manganese and vanadium, the total amount of these elements being 3 wt % or less; and the balance being copper and unavoidable impurities, said copper alloy sheet having a crystal orientation satisfying $2.9 \leq (f_{\{220\}}+f_{\{311\}}+f_{\{420\}})/(0.27 \cdot f_{\{220\}}+0.49 \cdot f_{\{311\}}+0.49 \cdot f_{\{420\}}) \leq 4.0$, assuming that the degree of orientation of a {hkl} crystal plane measured by the powder X-ray diffraction method on the rolled surface of the copper alloy sheet is $f_{\{hkl\}}$.

5. A copper alloy sheet as set forth in any one of claims 1 through 3 and 4, wherein the tensile strength of the copper alloy sheet in a direction perpendicular to the rolling direction and thickness direction thereof is not less than 600 MPa.

6. A copper alloy sheet as set forth in any one of claims 1 through 3 and 4, which has an electric conductivity of not less than 30% IACS.

7. A copper alloy sheet as set forth in any one of claims 1 through 3 and 4, wherein if the 90° W bending test of a bending test piece, which is cut off from the copper alloy sheet so that the longitudinal direction of the test piece is the rolling direction of the copper alloy sheet, is carried out so that the bending axis of the test piece is the direction perpendicular to the rolling direction and thickness direction of the test piece, the ratio R/t of the minimum bending radius R to the thickness t of each of the test pieces for the 90° W bending test thereof in the rolling direction and the direction perpendicular to the rolling direction and thickness direction of the test piece is 0.5 or less.

8. A copper alloy sheet as set forth in any one of claims 1 through 3 and 4, which has a stress relaxation rate of 7% or less, when the copper alloy sheet is held at 160° C. for 1000 hours so that the maximum load stress on the surface of the copper alloy sheet is 80% of the 0.2% yield strength.

9. A copper alloy sheet as set forth in any one of claims 1 through 3 and 4, which has a fatigue strength ratio of 0.55 or more.

10. A copper alloy sheet as set forth in any one of claims 1 through 3 and 4, wherein said thickness is in the range of from 0.08 mm to 0.5 mm.

11. A copper alloy sheet as set forth in any one of claims 1 through 3 and 4, wherein said mean grain size is in the range of from 1 μm to 8.7 μm.

* * * * *